United States Patent [19]

Bishop

[11] Patent Number: 4,491,415

[45] Date of Patent: Jan. 1, 1985

[54] ROTARY DRUM MIXING DEVICE

[76] Inventor: Robert J. Bishop, 1083 Bloomfield Ave., West Caldwell, N.J. 07006

[21] Appl. No.: 586,303

[22] Filed: Mar. 5, 1984

Related U.S. Application Data

[63] Continuation-in-part of Ser. No. 380,530, May 21, 1982, Pat. No. 4,435,082.

[51] Int. Cl.[3] ..... B28C 5/18; B28C 5/20; B28C 7/16

[52] U.S. Cl. ..... 366/47; 366/57; 366/60; 366/63; 366/185; 366/228; 366/232

[58] Field of Search ..... 366/42, 44, 45, 46, 366/47, 48, 53–59, 60, 62, 63, 185, 189, 187, 213, 220, 224–228, 232, 606

[56] References Cited

U.S. PATENT DOCUMENTS

| | | | |
|---|---|---|---|
| 603,227 | 4/1898 | Anderson | 366/232 |
| 1,863,029 | 6/1932 | Pispanen | 366/47 |
| 2,452,896 | 11/1948 | Bonney | 366/47 |
| 2,478,408 | 8/1949 | Lightburn | 366/57 |
| 2,573,296 | 10/1951 | Arant | 366/47 |
| 2,808,241 | 10/1957 | Beran | 366/57 |
| 4,197,015 | 4/1980 | Moser | 366/47 |
| 4,223,997 | 9/1980 | Violet | 366/47 |

*Primary Examiner*—Robert W. Jenkins
*Attorney, Agent, or Firm*—Howard E. Thompson, Jr.

[57] ABSTRACT

A light weight, inexpensive rotary drum mixing device is provided in which an essentially pear shaped drum, open at the small end and having an axially elongated socket at the large end, is rotatably supported on a unitary base having a transversely extended forward end and an upwardly and angularly extending rear end providing a bearing portion detachably engageable with said socket to rotatably support the drum at an inclination of about 35°, readily engageable means on the bearing portion and socket for preventing unintended axial movement, the forward end of the frame being slightly forward of the center of gravity of the rotatably supported drum to firmly support the same as drum contents are being mixed by rotation of the drum, and providing a pivot fulcrum for tilting the assemblage to discharge contents of the drum, and groove means adjacent the large end of the drum facilitating application of circumferential force to impart controlled rotation to the drum. The drum has a plurality of axially extending radial fins for lifting contents in rotation thereof and is preferably fashioned from molded plastic material either as a unitary body or as a plurality of interfitting parts.

The base is provided with an elongated extension detachably and adjustably mounted perpendicularly to the bearing portion and having means at the free end thereof for supporting a drive mechanism, including a belt drive pulley aligned with the groove means on said drum.

7 Claims, 7 Drawing Figures

FIG. 1
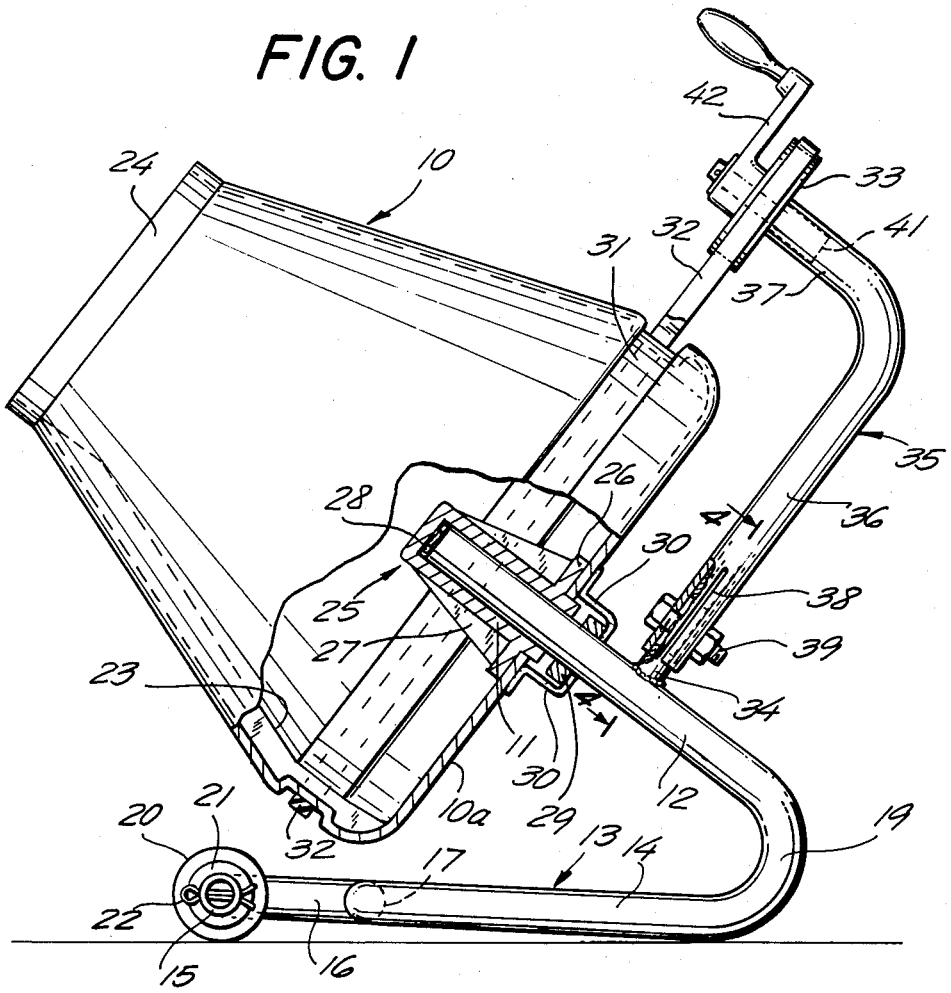
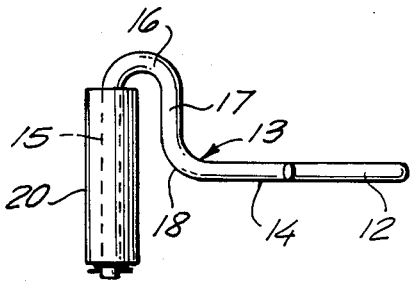
FIG. 2
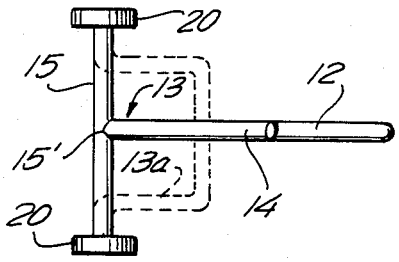
FIG. 3

ROTARY DRUM MIXING DEVICE

This invention relates to a light weight, inexpensive rotary drum mixing device in which an essentially pear shaped drum, open at the small end and having an axially elongated socket at the large end, is rotatably supported on a unitary base having a transversely extended forward end an an upwardly and angularly extending rear end providing a bearing portion detachably engageable with said socket to rotatably support the drum at an inclination of about 35°, readily engageable means on the bearing portion and socket for preventing unintended axial movement, the forward end of the frame being slightly forward of the center of gravity of the rotatably supported drum to firmly support the same as drum contents are being mixed by rotation of the drum, and providing a pivot fulcrum for tilting the assemblage to discharge contents of the drum, and groove means adjacent the large end of the drum facilitating application of circumferential force to impart controlled rotation to the drum. The drum has a plurality of axially extending radial fins for lifting contents in rotation thereof and is preferably fashioned from molded plastic material either as a unitary body or as a plurality of interfitting parts.

The base is provided with an elongated extension detachably and adjustably mounted perpendicularly to the bearing portion and having means at the free end thereof for supporting a drive mechanism, including a belt drive pulley aligned with the groove means on said drum.

This application is in the nature of a continuation-in-part of application Ser. No. 380,530, filed May 21, 1982, now U.S. Pat. No. 4,435,082, in the sense that the present invention incorporates a base structure and mixing drum generally similar to those disclosed in Ser. No. 380,530, but includes modifications in both the drum and the base structure making possible the use of a belt drive extending circumferentially of the drum at its largest diameter.

The mixer art, particularly as applied to cement mixers and the like, is known to be highly developed. The present invention relates to a limited segment of the mixer art, namely the relatively small size mixers which will handle, at one time, volumes of material to be mixed comparable to about 100 to 150 lbs. of a wet cement mixture. The device, in accordance with the present invention, is, therefore, particularly adapted to use by the homeowner in preparing small batches of cement, but this represents only a small segment of its potential utility as it can be used in many types of small batch mixing operations. It can be used, for example, in the blending of dry mixes such as tea and ground coffee blends, the dry ingredients for baked products and the like, as well as in the blending of fluid mixes such as in the blending of paint colors, fluid baking mixes and the like. It can also be used in the tumbling of small formed parts to remove burrs and achieve a degree of polish desired in such parts.

Based on applicant's long exposure to the mixer art and preliminary patent searches conducted to date, it is believed that the mixing device as herein disclosed involves a combination of simplicity and efficiency which is novel and patentable.

Regarded in certain of its broader aspects the mixing device, in accordance with the present invention, comprises a unitary frame having a base portion with a pivot fulcrum at the front end, an angularly, forwardly and upwardly extending bearing portion at the rear end, and a short connecting portion therebetween, the angularity of said bearing portion being about 35°, a generally pear shaped mixing drum closed and substantially flat at the large end, open at the small end, and having centrally of said closed end an elongated axial socket slidably engaging said bearing end of the frame to rotatably support said drum with its axis at said angle of approximately 35°, axially extending rib means on the inner surface of said drum for lifting contents in the rotation thereof, external means on said drum facilitating application of circumferential force to rotate the drum, the length of the connecting portion of said frame being such as to dispose said pivot fulcrum slightly forwardly of the center of gravity of the drum, readily engageable means on said bearing portion and socket to support the drum against axial movement when the assemblage is tilted around said fulcrum to discharge drum contents, said bearing portion being the only support for said drum, and said drum being readily removable from said frame upon disengagement of said last named means.

The pear shaped mixing drum, depending upon its intended use, can be fashioned from various materials such as metal, plastics, or even ceramic material; but is most suitably fashioned from molded plastic material such as high density polyethylene. It can be formed as a unitary cast or molded body or as a plurality of identical, interfitting sectors joined together at the rib portions of the drum. The elongated axial socket at the enlarged closed end of the drum can be formed as an integral part of the drum or as a separate part having a mounting plate for securing the same to the drum base.

The simple frame base serves the multiple purpose of rotatably supporting the drum at a desired angle of inclination, suitably about 35°, providing stability during the mixing operation, and properly aligning mechanical drive means, while facilitating, by reason of the pivot fulcrum being located slightly forwardly of the center of gravity of the drum, easy tilting of the assemblage to discharge drum contents.

In its simplest form the base frame comprises a unitary piece of tubing extending from a front portion through a "U" bend to a parallel section approximately one half the length of the front portion, then through an "L" bend to a connecting portion perpendicular to the front portion and then through an upward and forward bend perpendicular to the plane of said front and connecting portions terminating in the bearing portion which slidably and rotatably engages the socket portion of the drum.

In a slightly more expensive form of base an elongated piece of tubing forming the front portion has welded at the mid portion thereof a perpendicularly disposed tubing providing the connecting portion and having the rear end bent upwardly and forwardly in a plane perpendicular to the plane defined by the front and connecting portions and terminating in a bearing portion as above-mentioned. This form of base lends itself to the mounting of wheels at the ends of the front portion, if desired, to facilitate movement of the drum-base assemblage; whereas the simpler form above-mentioned lends itself to use of a roller extending longitudinally of the front portion to facilitate movement.

With either type of base above-described, mounting means for a mechanical drive mechanism is readily provided by welding to the upwardly extending portion of the base a member providing apparatus support means oriented above, and parallel to, the bearing portion of the base frame. Such member, in the device of the present invention comprises a stud for telescopic engagement with an elongated extension, somewhat longer than one half the drum diameter, and having offset means at the remote end thereof disposed parallel to said bearing portion providing support for drive means for the drum incorporating a drive pulley aligned with groove means at the large diameter of the drum for receiving a drive belt.

The drive means can be a simple hand drive having a crank in association with the drive pulley. The offset end of said extension can also support an electric motor having appropriate speed reducing engagement with the drive pulley. It should be noted in this connection that for cement mixing and the like a drum rotation of approximately 18 rpm is desirable. Thus, for a particular drum size, it is easy to determine the size of drive pulley which can conveniently be activated by a hand crank as well as the appropriate speed reduction needed between the electric motor and the drive pulley.

In a preferred adaptation of the invention the device will include means for readily switching between motor drive and hand drive to facilitate motor drive of the drum at a "mixing location", to be supplemented by hand drive when the device and contents may be moved to a "use location" remote from a source of electric power.

In the telescopic mounting of the drive support extension on the protruding member of the base, means is provided for axially adjusting the telescoping engagement to thereby facilitate appropriate tightening of the drive belt. This adjustable means also permits easy disengagement of the extension to facilitate compact shipping and storage of the device.

Novel features of the present invention will be more readily understood from a consideration of the following description having reference to the accompanying drawing, in which preferred adaptations of the invention have been illustrated with the various parts thereof identified by suitable reference characters in each of the views, and in which:

FIG. 1 is a side elevation view of a rotatable mixer and support base with part of the structure broken away and in section.

FIG. 2 is a view of the base as seen in the direction of the arrows 2—2 in FIG. 1.

FIG. 3 is a view similar to FIG. 2 showing a modified base construction.

Figure 4:
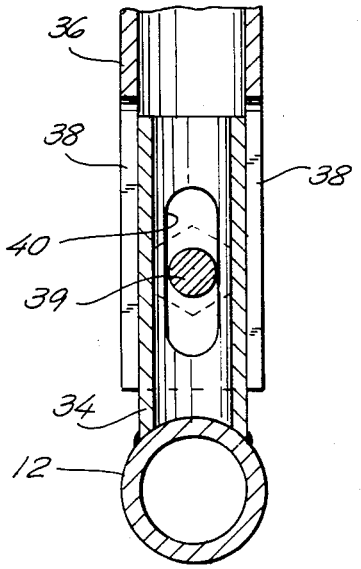
FIG. 4 is an enlarged fragmentary sectional view substantially on the line 4—4 of FIG. 1.

As shown in the drawing the mixer, in accordance with the present invention, comprises a generally pear shaped drum 10 rotatably engaging, via an axially extending socket 11, the bearing portion 12 of a support base 13. The bearing portion 12 is upwardly and forwardly inclined at an angle of about 35° with respect to a connecting portion 14 which joins the bearing portion 12 to a transversely disposed member 15 positioned slightly forwardly of the center of gravity of the drum 10, and functioning as a pivot fulcrum when tipping the assemblage to discharge drum contents.

The base 13 in its simplest form comprises a unitary piece of tubing with a "U" bend 16, short portion 17 and "L" bend 18 disposing the connecting portion 14 perpendicularly to the transversely disposed member 15. The reverse bend at 19 positions the bearing portion 12 in a plane aligned with the connecting portion 14 and perpendicular to the plane defined by the connecting portion 14 and transverse member 15. In order to facilitate movement from place-to-place a roller 20 is suitably mounted on the transverse member 15 and may be detachably supported thereon as by washer 21 and cotter pin 22.

In the modified structure shown in FIG. 3 the transverse member 15 comprises a separate tubular part welded at its mid point 15' to the connecting portion 14 of the base frame. This structure facilitates the mounting of wheels 20' at ends of the transverse member 15 if desired to facilitate moving the drum-support base assemblage from place to place.

The drum 10 is provided with three or more inner axially and radially extending ribs 23 at equally spaced intervals circumferentially of the drum. The ribs 23 can be independent members secured to a preformed drum but, as illustrated in FIG. 1, preferably comprise integral molded or cast parts of the drum.

In this connection the drum, depending upon the type mixing for which it is intended, can be fashioned from various materials such as metals, plastics or even ceramic material. From the standpoint of ease of fabrication, light weight durability, and ease of cleaning and maintenance, the drum is suitably fashioned from plastic materials, with high density polyethylene being particularly advantageous for many uses.

To better visualize the size of the assemblage shown in FIG. 1 the drum 10 has a maximum diameter of about 22 inches, an axial length of about 22 inches, and a diameter at the open end 24 of about 11 inches imparting to the drum its essentially pear shaped contour. With a drum of this size, and a socket portion 11 extending 5 to 6 inches coaxially of the drum, the assemblage can readily handle the blending of as much as about 120–140 lbs. of a wet cement mixture.

While the socket 11 can be formed as an integral part of the cast or molded drum 10, it preferably comprises a separately formed part 25 having a radial flange 26 for securing the same to the drum buttom **10*a* by circumferentially spaced bolts (now shown). For added strength the part 25 may be provided with a plurality of circumferentially spaced ribs 27**.

The part 25 can be fashioned from metal or rigid plastic to provide suitable wear resistance in the socket 11; and such wear resistance is suitably enhanced by providing a bearing insert 28 at the inner end of the socket 11.

The bearing portion 12 of the base is provided with a radial flange 29 positioned close to the open extremity of the socket part 11 which is engaged by spring clips 30 secured to the drum buttom **10*a* at diametrically opposed positions. The spring clips 30 serve to support the drum 10 against axial sliding movement on the bearing portion 12 when the assemblage is tilted about the fulcrum 15 in the emptying of drum contents. At the same time the spring clips 30 can readily be flexed to disengage the flange 29 to permit intended removal of the drum 10** from the base.

The drum 10 is provided at its widest portion with an annular belt receiving groove 31 for receiving a belt 32 in operative engagement with a drive pulley 33. For proper orientation and support of the drive pulley, the bearing portion 12 of the base is provided with a perpendicularly disposed extension 34 which is telescopically engaged by a detachable and adjustable extension 35 of generally L-shaped contour having a long portion 36 which engages the extension 34 and a short portion 37 which is disposed parallel to the axis of the bearing portion 12.

The lower end of the extension 35 has diametrically opposed slits 38 as clearly shown in FIGS. 1 and 4 to permit clamping engagement with the extension 34 by tightening a bolt 39 which passes through an elongated aperture 40 in the extension 34.

The extension 34 can be of solid stock or heavy tubing as shown in FIG. 4; and in either event it is apparent that engagement of the bolt 39 with the slot 40 (or spaced slots of a tubular member 34) provides effective means for maintaining alignment of the extension end 37 parallel to the bearing portion 12 of the base.

The elongated slot 40 permits relative longitudinal movement between the parts 34 and 35 when the bolt 30 has been loosened to thereby adjust the location of the drive pulley 30 to provide proper tension in the belt 32. It will also be apparent that by removing the bolt 39 the extension 35 and drive pulley 33 can be easily removed from the base for compact storage and shipping of the device.

The drive pulley 33 is carried by a bearing member 41 detachably or fixedly secured within the short end 37 of extension 35 providing free rotation of the drive pulley. In the adaptation shown in FIG. 1 the drive pulley 33 has secured thereto a hand crank 42 facilitating easy manual rotation of the drum 10.

Having reference to the drum size earlier mentioned the annular groove 31 in the drum will have an effective diameter of about 20.5 inches. With a drive pulley 33 having an effective diameter of 5 inches, the desired speed of rotation of the drum of about 18 r.p.m. can be attained by operating the crank 42 at about 78 r.p.m. This is considered to be a comfortable speed for hand operation in mixing batches of cement and the like.

While hand mixing is quite practical when the need is merely for infrequent, small batches of cement, it is desirable in instances where more sustained use is intended to provide a power drive for the drive pulley 33. Such a power drive has been illustrated in FIG. 5 of the drawing where drive pulley 33 is secured to, or formed integrally with a gear 43 which meshes with a small gear 44 driven by an electric motor 45 having a wire lead 46 to a suitable source of electric current. The motor 45 is mounted on the short end 37 of extension 35 by means of a strap 47 readily tensioned by adjustable means as indicated by the bolt 48. Proper positioning of the motor 45 to align the gears 43 and 44 is provided by a spacing member 49 of appropriate dimension which is clamped between the extension end 37 and the motor 45 by tightening of the strap 47.

Figure 5:
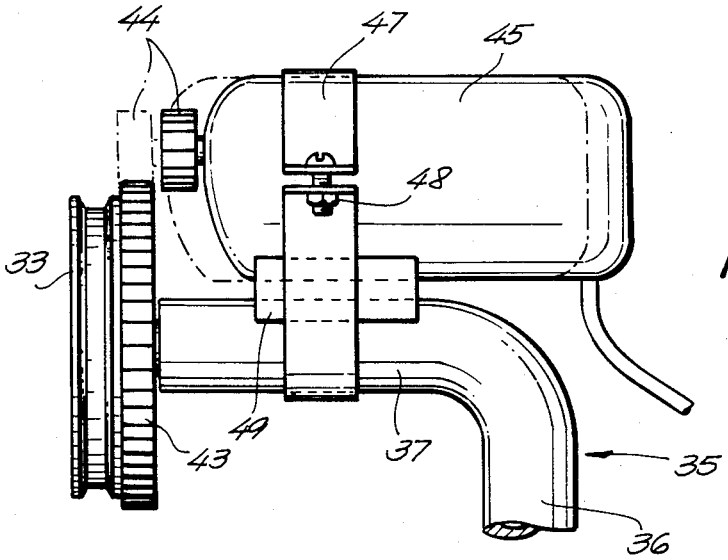
FIG. 5 is an enlarged view of the portion of the structure shown in FIG. 1 illustrating an electric motor drive.

The full line showing in FIG. 5 illustrates the motor 45 in a position to disengage the gears 43 and 44, whereas the dotted line showing illustrates these gears in meshed relation. It will be apparent that movement between the two positions is easily accomplished by merely loosening and retightening the bolt 48 to permit axial movement of the motor.

A practical electric motor for use in the mechanized drive is one operating at about 540 r.p.m. With this type motor, and a 1 inch gear for the gear 44, it is possible to select sizes for the gear 43 and drive pulley 33 which will provide the desired speed of rotation in the drum. As earlier indicated a rotation speed of about 18 r.p.m. is practical for cement mixing; but it will be understood that in adapting the device to particular type mixing operations, the different drum rotation speeds which might be desired can easily be obtained by varying sizes in the gears 43,44 and drive pulley 33. It will be noted in this connection that the size of the spacer 49 must in each instance be adapted to the particular sizes of gears 43,44 being used.

Figure 6:
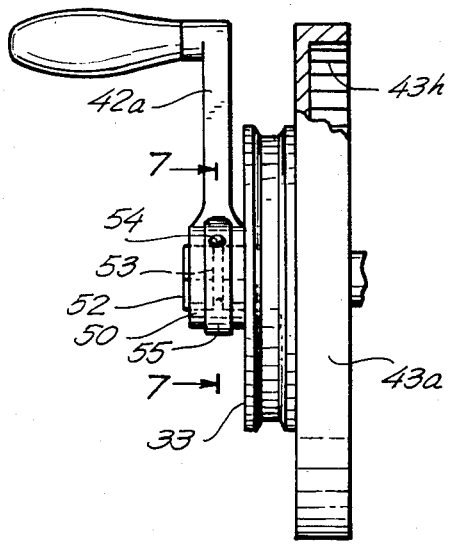
FIG. 6 is a detail view of the drive pulley/gear member shown in FIG. 5 illustrating a modification.

FIG. 6 of the drawing illustrates a modified form of gear pulley assemblage in which the gear portion **43*a* is enlarged to provide an internal gear track 43*b* which will be engaged and disengaged by the drive gear 44 by movement of the motor 45** in the manner previously described.

Figure 7:
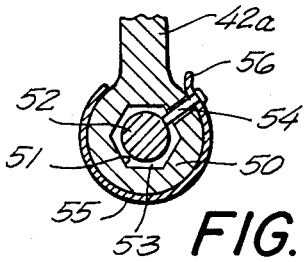
FIG. 7 is a sectional view substantially on the line 7—7 of FIG. 6.

FIGS. 6 and 7 also disclose a removable hand crank **42*a* which is readily attachable and detachable with respect to the drive pulley gear assemblage. The hub portion 50 of the hand crank 42*a* is provided with a hexagonal or other irregular central passage 51 interfitting with a similarly contoured stud 52 on the drive pulley 33. The stud 52 is shown as provided with an annular groove 53 engageable by an inwardly extending key 54 on a spring 55 extending circumferentially of the hub 50. The spring 55 is provided adjacent the key 54 with a finger grip 56 permitting easy withdrawal of the key 54 from its engagement with the groove 53**.

The easily removable hand crank **42*a*, which can also be adapted to the structure shown in FIG. 5, provides extreme versatility in use of the device. With the hand crank disconnected, major mixing can be done with the motor drive. Then as the mixed cement or other drum contents may be moved from the "mixing station" to a "use station" where electric power may not be readily available, the motor can be simply moved to disengage gears 43,44, the hand crank 42*a* mounted on the drive pulley 33, and mixing can then be continued by hand at the "use station", both to maintain proper mixture of contents and to facilitate emptying of drum contents as the assemblage is tilted about the fulcrum 15**.

A special advantage of the mixing device herein disclosed is the compactness in which its parts can be rearranged for shipping and storage purposes. It will be noted in this connection that when the drum is detached from the base and the extension 35 is disengaged from the bearing portion, and the bearing portion then inserted into the open end of the drum, the reoriented parts can be stored in a container only slightly larger than the drum. The compactness of storage can be further enhanced by modifying the base structure as indicated in the dotted line showing **15*a* in FIG. 3**.

Various changes and modifications in the mixing device as herein disclosed may occur to those skilled in the art; and to the extent that such changes and modifications are embraced by the appended claims, it is to be understood that they constitute part of the present invention.

I claim:

1. A mixing device comprising a unitary frame extending front to rear of the device, said frame having a base portion with a transverse member forming the front end of said frame and providing a pivot fulcrum at said front end, a short connecting portion joined to said transverse member, said connecting portion terminating in an angularly, forwardly and upwardly extending portion providing a bearing portion at the rear end of said frame, the angularity of said bearing portion being about 35° with respect to the plane of said base portion, a generally pear shaped mixing drum providing large and small ends, said drum being closed and substantially flat at the large end and open at the small end, said closed end having an elongated axial socket, extending inwardly of said drum, said axial socket slidably engaging said bearing end of the frame to rotatably support said drum with its axis at said angle of approximately 35°, axially extending rib means on the inner surface of said drum for lifting contents in the rotation thereof, circumferential groove means adjacent the large end of said drum facilitating application of circumferential force to rotate the drum, drive means for imparting such circumferential force located above said bearing portion with the rotational axis thereof parallel to the axis of said bearing portion, said drive means including a pulley aligned with the groove means on said drum, a belt operatively engaging said pulley and groove means, an integral upwardly directed projection on said bearing portion perpendicular to the axis thereof, an extension having means at one lower end for detachably and adustably securing the same to said projection, an offset portion at the upper end of said extension disposed parallel to the axis of said bearing portion and providing the sole support for said drive means, the length of the connecting portion of said frame being such as to dispose said pivot fulcrum slightly forwardly of the center of gravity of the drum, readily engageable and disengageable means on said bearing portion and socket to support the drum against axial movement when the assemblage is tilted around said fulcrum to discharge drum contents, said bearing portion being the only support for said drum, and said drum being readily removable from said frame upon disengagement of said last named means.

2. A mixing device as defined in claim 1, wherein said drive means includes a hand crank secured to said pulley.

3. A mixing device as defined in claim 1, wherein said drive means includes an electric motor driving said pulley.

4. A mixing device as defined in claim 3, wherein said electric motor is operatively linked with said pulley through speed reduction means.

5. A mixing device as defined in claim 4, wherein the speed reduction means includes a small gear on said motor intermeshing with a large gear on said pulley.

6. A mixing device as defined in claim 5, wherein said motor is positioned by adjustable mounting means facilitating axial movement of the motor for engagement and disengagement of said gears.

7. A mixing device as defined in claim 6, wherein a supplemental drive is provided by a hand crank detachably secured to said pulley when said gears are disengaged.

* * * * *